United States Patent [19]

Cardwell et al.

[11] 4,146,572

[45] Mar. 27, 1979

[54] SIMULTANEOUS EXTRACTION OF METAL VALUES OTHER THAN COPPER FROM MANGANESE NODULES

[75] Inventors: Paul H. Cardwell, Zanoni; William S. Kane, Wicomico, both of Va.

[73] Assignee: Deepsea Ventures, Inc., Gloucester Point, Va.

[21] Appl. No.: 733,241

[22] Filed: Oct. 18, 1976

[51] Int. Cl.[2] ..... C01G 3/14; C01G 51/12; C01G 53/12

[52] U.S. Cl. ..... 423/32; 423/50; 423/144; 423/150; 423/DIG. 4

[58] Field of Search ..... 423/24, 32, 33, 49, 423/50, 63, 139, 144, 150, 419; 75/100 BE, 21, 80, 103, 117, 119, 108, 121

[56] References Cited

U.S. PATENT DOCUMENTS

| | | | |
|---|---|---|---|
| 2,724,645 | 11/1955 | Stringham et al. | 75/121 |
| 2,775,508 | 12/1956 | Thomsen | 423/144 |
| 2,879,137 | 3/1959 | Bare et al. | 75/103 |
| 3,276,863 | 10/1966 | Drobnick | 423/493 |
| 3,471,285 | 10/1969 | Rolf | 75/80 |
| 3,714,326 | 1/1973 | Matson | 423/150 |
| 3,734,715 | 5/1973 | Redman | 75/103 |
| 3,743,585 | 7/1973 | Lowenhaupt | 75/119 |
| 3,751,554 | 8/1973 | Bare et al. | 75/103 |
| 3,761,250 | 9/1973 | Weir et al. | 75/119 |
| 3,988,224 | 10/1976 | Barriere et al. | 423/139 |

*Primary Examiner*—Brian Hearn

*Attorney, Agent, or Firm*—Barry G. Magidoff

[57] ABSTRACT

This invention provides a two-stage leaching procedure for manganese nodules for obtaining directly from a second leaching stage a substantially pure stream of copper free of other metal values, the other metal values, including manganese, nickel and cobalt, having been previously extracted in an earlier leaching stage. Both leaching operations are carried out utilizing an ammoniacal aqueous solution on a reduced manganese nodule.

22 Claims, 2 Drawing Figures

SIMULTANEOUS EXTRACTION OF METAL VALUES OTHER THAN COPPER FROM MANGANESE NODULES

It is not a common situation to obtain a relatively valuable non-ferrous metal such as nickel, cobalt, copper and zinc together with a relatively large proportion of manganese and a significant quantity of iron. A relatively untapped source of high-quality manganiferous ore, however, is a material which is found on the ocean floor and has come to be known as ocean floor nodule ore, or manganese nodule ore.

With the increased awareness on the part of both the public and the metals industry of the ecological dangers that can arise from continued surface mining of minerals required for most ores mined from the land, as well as the recent diminution in the availability of valuable industrial ores, the mining industry has become interested within the last several years in the mining of minerals from the sea. This has been an extremely elusive target up to the present. One method of obtaining such minerals has been the dredging of the deep ocean floor to obtain an ore which has variously become known as ocean floor nodule ores, manganese nodules or merely nodules. Such minerals can be merely scooped up from the top surface of the ocean floor without requiring a rending of the earth's surface.

The nodule ore was first collected during the first part of the 1870's. Deposits of this ore are found as nodules, lying on the surface of the soft sea floor, as large slabs on the ocean floor, or as replacement fillings in calcareous debris and other animal remains. They have been studied by many workers in an attempt to determine their precise composition, and then to decipher ways to wrest from their peculiar structure the valuable metals contained therein. It is presently believed that these nodules are actually creations of the sea; they are somehow grown, generally in the form of the metal oxides, from metal values which are dissolved in sea water.

The metal values of the nodules are almost exclusively in the form of oxides and moreover are present in extremely peculiar physical configuration. The physical and chemical structure of the nodules are believed to be a direct result of the conditions under which they were created and to which they have been exposed since their creation. First, nodule ore has never been exposed to temperatures other than those at the bottom of the ocean at the location at which they were formed. The nodules ores have an extremely large surface area, a porosity often greater than 50%, and are relatively chemically reactive ores. The solid structure of the nodules is extremely complex, seemingly formed of many crystalites, but without any recognizable overall crystalline pattern or structure. The nodules are formed basically of what appears to be an extremely complex arrangement, or matrix, of iron and manganese oxides: tiny grains of each oxide of a size and type which are substantially impossible to separate by presently available physical means. These iron and manganese oxides form the basic structure within which other metal values are retained, in what is believed to be at least partially a result of a substitution mechanism. These other metal values include, as the major ingredient, nickel, copper and cobalt, and in addition, chromium, zinc, tin, vanadium and other metals, including the rare metals, silver and gold.

In addition to the metal oxides, described above, there is also present a large quantity of silt, or gangue material, intimately admixed with the nodule ore. This silt, or gangue, is sand and clay, and includes the usual oxides of silicon and aluminum and varying proportions of some carbonates, especially calcium carbonate.

The precise chemical composition, as well as the physical structure, of the nodules vary somewhat depending upon their location in the ocean. Variation is perhaps caused by differences in temperature in various places, and at different depths, differences in the solute composition of sea water, perhaps caused by the pressure variations at different depths and the composition of adjacent land areas, variations in the amount of oxygen which is present in the water in different locations, and perhaps other variables not readily apparent to observers. Generally, however, in almost all cases, the metals which are present in primary proportions are manganese and iron, and the predominant secondary metals are generally nickel, copper and cobalt. A detailed analysis of a variety of different nodule ores can be found in an article entitled "The Geochemistry of Manganese Nodules and Associated Deposits From the Pacific and Indian Oceans" by Croonan and Tooms, in *Deepsea Research* (1969), Volume 16, pages 335–359, Pergamon Press (Great Britain).

As a general rule, the nodule ores can be considered as containing the following metal content ranges, derived on a fully dry basis.

| | Percent |
|---|---|
| Copper | 0.8 – 1.8 |
| Nickel | 1.0 – 2.0 |
| Cobalt | 0.1 – 0.5 |
| Manganese | 10.0 – 40.0 |
| Iron | 4.0 – 25.0 |

Because of the peculiar and intricate crystal structure of the ocean floor nodules, many of the common refining techniques used for the refining of land ores are not generally suited for the nodules. Most especially, because of the great value attached to the nickel and copper values in the manganese nodules, and the relatively large amounts of manganese found in these ores, special procedures are needed, which are not relevant to terrestrial ores, for the refining of these materials.

Among the procedures is included the reduction of pellets prepared from manganese deepsea nodules, to form metallic copper, nickel and cobalt, within the pellets, followed by leaching with an ammoniacal ammonium salt solution to obtain the copper, nickel and cobalt salts in solution without dissolving any manganese or iron. The leaching is carried out in the presence of aeration, see U.S. Pat. Nos. 3,788,841 and 3,741,554.

Nodule ores have also been treated by two-phase leaching utilizing ammoniated ammonium salt solutions, wherein the temperatures vary, to initially extract copper under milder, room temperature conditions, and subsequently to extract nickel under higher temperatures (U.S. Pat. No. 3,736,125). A selective reduction of the manganese nodules permits the selective leaching of copper, nickel, cobalt and molybdenum, without the leaching of manganese, according to U.S. Pat. No. 3,734,715, while the partial reduction of a nodule ore charge, when utilizing an ammonia solution also containing manganous ions, permits the leaching of copper, nickel, cobalt and molybdenum (U.S. Pat. No. 3,723,095). The prior art also recognized, in U.S. Pat.

No. 3,734,715, that upon "over-reduction" a portion of the copper and nickel may not be "recoverable" by leaching.

As stated above, the manganese nodule ores are almost unique in that they contain a relatively large number of valuable metal values, including manganese, nickel, cobalt and copper. Because of the large number of metal values which are present in the ores, and which should be recovered in order to render the treatment of such ores most economic, the separation of the various metals, one from the other, becomes a significant aspect of any recovery process. One particularly useful method for obtaining individual streams of these metal values includes contacting an aqueous solution of a combination of these metal values with a liquid ion exchange medium to selectively extract one or more of the metal values from the mixed solution. A particularly valuable, and important, metal value is copper. The copper has in the past, as stated above, been leached out together with the other metal values, particularly cobalt and nickel. This has resulted in the requirement for additional liquid ion exchange stages in order to effect a substantially complete separation of the copper from the other metal values. It is, accordingly, an object of the present invention to provide a process for obtaining a separate leach solution containing copper, without the requirement of a subsequent liquid ion exchange procedure to selectively extract copper from a solution also containing cobalt and nickel. It is a further object of the present invention to obtain a leach solution containing the remaining metal values other than copper from the manganese nodule ore. Yet a further object of this invention is to provide a continuous process for obtaining metal values, wherein copper is obtained in a separate leach stream, wherein the leaching solutions can be recovered and recycled for future use and the individual metal values separated therefrom in separate streams.

In accordance with the present invention, there is provided a process for selectively removing metal values from a manganese nodule ore, the ore comprising primary proportions of manganese and iron and secondary proportions of nickel, copper and cobalt. Most preferably, the ore contains a manganese:iron ratio of at least about 5:1 and optimally about 6:1, and a total proportion of copper, nickel and cobalt of at least about 1.5% by weight. The process comprises the steps of: (a) reducing the manganese nodule ore, whereby the copper value in the ore is reduced to a state at which it cannot be leached by ammoniacal solution unless the copper value is oxidized; (b) leaching the reduced ore with an aqueous ammoniated solution of an ammonium salt to dissolve out manganese, nickel and cobalt values from the ore, but substantially without oxidizing any copper value, so as to obtain a pregnant aqueous leach solution comprising dissolved manganese salt, cobalt salt, and nickel salt, and a solid leached ore, the pregnant leach solution being substantially free of dissolved copper salt; and (c) oxidizing the solid leached ore so as to oxidize the copper value to a valence state at which it can be leached with an ammoniated aqueous solution and releaching the oxidized solid leached ore with an ammoniated aqueous solution of an ammonium salt to dissolve out the remaining copper value, so as to form a pregnant aqueous releach solution comprising dissolved copper salt, and a solid, final residue.

In a preferred embodiment of this process, the pregnant leach solution is then further treated to separate the individual metal values dissolved therein by initially removing the manganese and iron values therefrom, by causing the precipitation of insoluble compounds thereof, separating the manganese and iron precipitates from the remaining aqueous solution and treating the remaining aqueous solution with liquid ion exchange agents to selectively extract and separate the remaining cobalt and nickel values into separate solutions thereof.

In accordance with this process, the nodule ore is preferably initially dried and the reduction carried out under anhydrous conditions. The drying can be carried out in the same or separate stage, at temperatures substantially below the reduction temperatures. The drying temperatures are preferably no greater than about 250° C. and most preferably at temperatures in the range of from about 150° C. to about 250° C.

In order to increase the rates of drying and subsequent reduction and leaching of the nodule ore, the ore is preferably initially comminuted, as by grinding and crushing to a particle size of not greater than about 20 mesh, U.S. Sieve Scale, most preferably not greater than about 50 mesh and optimally not greater than about 100 mesh.

The dried and comminuted nodule ore is next reduced preferably at a temperature of at least about 300° C. The reduction is most easily and economically carried out by reacting the nodule ore with a carbonaceous or hydrogen-containing reducing agent, which is itself oxidized to either carbon dioxide or water vapor when the metal values are reduced.

The intent of the reducing step is to change the structure of the nodule ore into a form which is readily leachable by the ammoniated ammonium salt solutions described herein, and to convert the copper into a state at which it is not leachable by the ammoniated ammonium salt solutions. It has been found that the nodule ore as obtained from the ocean floor, even after drying, is not readily susceptible to leaching utilizing the ammonium salt solutions of the present invention. After reduction, however, it has been found that the metal values can be readily dissolved into such an ammoniated ammonium salt solution, in accordance with the process described below.

The reduction to be carried out in accordance with the present step of the process of this invention should result in substantially all of the manganese originally present in the ore in the tetravalent state being reduced to the divalent state. Concurrently with the reduction of the manganese, there must, almost of necessity, be a concurrent reduction of the nickel, cobalt and copper values present in the ore. It is not clear to exactly what valence state the nickel, cobalt and copper are reduced. It is generally believed, however, that the nickel and cobalt are reduced to a state below that at which they are found in the ore and that the copper is believed to be reduced to the elemental state, in accordance with the present invention, in order to render the copper not leachable by the ammoniated salt solution. However, the exact valence states to which these materials, and especially the copper, are reduced are not necessary to an understanding of this invention. It is only necessary that when carrying out the reduction, the parameters are so set that the copper value is rendered substantially not leachable by the ammoniated ammonium salt solutions.

In actual practise of this invention, the nickel and cobalt values in the reduced ore are possibly perhaps also reduced, in step (a) above, to a state in which they cannot be leached by an ammoniacal solution unless they are first oxidized. This has not been determined. However, no special care need be taken in order to obtain or prevent this result; it has been found that by leaching under ambient conditions, i.e. exposed to the air but without bubbling air through the solution, the cobalt and nickel are leached out, but the copper is not leached out and remains in the solid leached ore. The reduced ore is then subjected to more rigorous oxidizing conditions in step (b) to oxidize the copper, for example by oxygenating the ore-and-releaching liquid suspension by bubbling air therethrough, or by applying another strong oxidizing agent.

Thus, a pragmatic test for determining whether copper has been sufficiently reduced is to determine whether, without exposing the reduced ore to oxidative conditions, the ore can be leached with an ammoniated ammonium salt solution, and if not, whether it can be leached by subjecting the ore to oxiding conditions, e.g., by aerating the leaching solution while in contact with the ore. If the copper is leached under the second condition, then one can be assured that the ore had been sufficiently reduced in the reduction step, and the process in accordance with the present invention can be carried out.

It has been found that any iron value will also generally be reduced to a state below that in which it is normally found, and that at least part of the iron is reduced to a state where it is not leached out together with the manganese value in accordance with the first leaching step of the present invention. This, what is in effect limited-reduction of the iron, is desirable in decreasing the iron in the leach solution so as to minimize the problems of subsequent separation of iron from manganese in the leach solution. Generally, the relative proportion of manganese and iron in the nodule ore is somewhat too rich in iron to obtain a valuable commercial product if all the iron were to be leached out in the same proportion as the manganese.

The exact mechanism by which the various metal values are reduced or oxidized, and even the valence states to which they are reduced or oxidized, have not been precisely determined, but need not be known for the satisfactory carrying out or regulation of the process of the present invention.

Although the scope of this invention should not be limited thereto, it is believed that generally any reducing agent which has sufficient reducing strength to reduce tetravalent manganese to divalent manganese and to reduce the copper values in the ore to an insoluble state can be utilized for the reducing stage of this invention. It should, of course, be noted that the reducing agent need not be a pure compound or element and that a combination of two or more reducing agents can be utilized. For example, many natural products, such as hydrogen, natural gas or coal, or manufactured gas, e.g., producer gas, contains a combination of compounds or elements at least some of which provide at least some reducing action with regard to the metal values in the nodule ore. Generally, elemental carbon in any physical state, including amorphous or graphitic carbon, or natural or semi-manufactured solid carbonaceous materials, such as coal, peat, charcoal, and coke, can be used. Oil or other organic sources can be utilized as a source for the reducing action of carbon, and any hydrocarbon can be used: aromatic, aliphatic or cylcoaliphatic, or compounds having combinations of these groups, without interfering with the reducing action. Solid hydrocarbon compounds, especially the higher condensed ring aromatic materials, including most especially those derived from petroleum or other natural mineral products which are often available as by-product tars from the refining of these materials, have the highest proportion of carbon among the hydrocarbons, and, therefore, provide a desirable unit weight effectiveness as a solid reducing agent. Gaseous materials, such as carbon monoxide, alone or admixed with hydrogen, as in reformer gas, can also be readily utilized as reducing agents. As stated earlier, hydrogen itself is a strong and effective reducing agent, and, if available cheaply enough, can be used commercially.

Generally, the most efficient temperature, or temperature range, for the reduction reaction is dependent upon the reducing agent utilized. The reducing agents, which are most effective in reducing tetravalent manganese to the divalent state, and which also can reduce the other metal values present, at temperatures as low as about 300° C. in accordance with this procedure, include normally gaseous materials such as hydrogen and carbon monoxide, and synthetic mixtures thereof. Other fluid reducing agents, such as, for example, the lower, gaseous or liquid, hydrocarbons, which are somewhat less effective in reducing manganese and the other metal values, should be used at somewhat higher temperatures of at least about 500° C. Generally, the solid reducing agents, such as elemental carbon, e.g., coal, or the higher solid hydrocarbons, would be utilized at higher temperatures of at least about 550° C.

Generally, for a given reducing agent, the higher the temperature of reaction, the shorter should be the reaction time, in order to avoid over-reduction of the ore. In any event, generally, a temperature greater than about 850° C. is unnecessary and introduces difficulties in the subsequent leaching steps, so that preferably temperatures in the range of from about 350° C. to about 800° C. are preferred, but optimally, temperatures not greater than about 750° C. are utilized.

The reduction of the nodule ore can be carried out on a batch or a continuous basis. The time of reaction is substantially the same and is measured as "residence time," for either basis. The reduction reaction time, or residence time, is generally maintained at from about 0.5 to about 3 hours, and preferably 0.75 to about 1.75 hours.

The reduced ore must then be leached without subjecting the ore to oxidizing conditions severe enough to oxidize copper. This includes avoiding the exposure of the hot reduced ore to the atmosphere. Accordingly, upon completion of the reduction, the ore should be permitted to be cooled without being exposed to the air, for example, by passing nitrogen or other inert gas over the ore as it cools down, or permitting the ore to cool down under reducing conditions, for example, the passage of hydrogen or carbon monoxide, and then quenching the reduced ore in the leach solution as soon as it has cooled down to below a temperature at which it would cause boiling of the solution.

The reduced ore is next subjected to an aqueous leaching, utilizing an aqueous solution of ammonium hydroxide, i.e. dissolved ammonia, $NH_3$, and an ammonium salt. The divalent manganese value present in the reduced ore has been found to be leached together with the nickel and cobalt values by the ammoniated ammonium salt solution when the ammonium salt solution contains a minimum of 150 grams per liter of total dissolved ammonium ion, including both the salt and the ammonium hydroxide, and preferably at least about 260 grams per liter $NH_4$ +; and the concentration of the ammonium salt anion being at least about 0.83 Normal. The concentration of dissolved free ammonia, i.e. as $NH_4OH$, is preferably at least about 120 grams per liter $NH_4$+.

It is believed that at the very high concentrations of ammonia required in accordance with the process of the present invention, a complex of the ammonia with the manganese value is formed rendering the manganese salt soluble at a pH at which it would ordinarily be insoluble. Without limiting the scope of this invention, the solution of the manganese, as well as the nickel and cobalt, is believed to follow the following net reaction equation, utilizing manganese and ammonium carbonate as examples:

I. $MnO + H_2O + 2NH_4^{+} + CO_3^{=} + yNH_3 \rightarrow Mn(NH_3)y^{++} + Co_3^{=} + 2NH_4OH$ The above equation is the net result of the process occurring in the dissolution of the manganese value in the manganese nodule. As substantially similar reaction is also believed to occur during the dissolution of the nickel value from nickel oxide (NiO), and cobalt value from cobalt oxide (CoO).

There must be sufficient quantity of ammonia dissolved in the leaching and releaching solutions to cause the solution of the desired metal value, specifically the manganese, nickel and cobalt, and copper, respectively, by forming the ammonia/metal complexes. Although the precise ratio between the ammonia and the metal ion in the complex is not known with definition, without seeking to limit the scope of this invention, it is believed that from about 3 to about 5 mols of ammonia per mol of metal should be dissolved in the leaching solution to provide the desired ammonia/metal complexes.

Although the maximum concentration of the free ammonia and ammonium salt is not crucial, it has been found that it is generally unnecessary to provide a completely saturated solution of the ammonium salt, as this will provide generally too great an excess of the salt.

A quantity of iron is also generally dissolved by the ammoniated ammonium salt leaching solution from the reduced ore residue. The iron is undesirable as it can interfere with the subsequent treatment of the leach solution to separate the desired metal values, specifically nickel, cobalt and manganese, into separate streams. However, the iron can be removed together with the manganese without interfering with the commercial value of the thus separated manganese, especially if some of the iron had been reduced to a non-leachable state. The proportion of manganese-to-iron precipitated is such that a commercially valuable ferromanganese product can be obtained containing the ratio of manganese-to-iron.

A solid manganese compound, admixed with the companion iron compound, can be obtained from the leach liquid by a variety of methods, including precipitation and crystallization. The manganese and the iron value can be caused to precipitate by removing a portion of the dissolved ammonia, for example, by sparging the solution with air or nitrogen or other gas which does not interfere with the solution of the remaining metal values. Although the sparging can be carried out at temperatures as low as ambient, preferably the sparging with gas is carried out at temperatures greater than 40° C. and preferably greater than 50° C., and optionally up to about 75° C., although, generally, temperatures up to but not including boiling of the solution can be utilized, if desired. Furthermore, if desired, ammonia can be driven off by boiling the solution without sparging.

There is very little danger of causing the precipitation of any of the other desired metal values, i.e., cobalt and nickel, together with the iron and manganese, as long as care is taken to insure that the sparging and/or boiling is terminated once the precipitation of the iron and manganese has ceased. The precipitation of any nickel and cobalt does not occur until a substantially greater amount of the ammonia is removed than is necessary to precipitate substantially all of the manganese and iron. These manganese and iron precipitates can be readily separated from the solution by, for example, filtration.

In those situations where the original leach solution contains two high a proportion of iron to form a commercially valuable ferro manganese product by the combined precipitation of iron and manganese compounds, it is possible to preferentially initially precipitate iron compounds and then precipitate the manganese and remaining iron compount in a commercially valuable ratio. Sparging with air to preferentially remove iron can be carried out at room temperature. This results initially in the precipitation of iron, or a mixture of iron and manganese values, after which the precipitate can be separated from the remaining solution. Continued sparging at elevated temperatures is then carried out until substantially all of the remaining iron and manganese is precipitated in the more desirable ratio.

The resulting manganese- and iron-free leach solution is a relatively pure solution of the two valuable metal values from the ore, i.e., nickel and cobalt, together with a relatively smaller proportion of other valuable metal values. The relatively pure solution of the nickel and cobalt salts can be then treated in a variety of ways to obtain the individual metal values in a pure state.

One preferred method of separating the individual nickel and cobalt values from the solution is by liquid ion exchange procedures. One such liquid ion exchange procedure is shown, for example, in U.S. Pat. No. 3,276,863. This procedure is especially effective when the ammonium salt is the carbonate.

In accordance with the procedure of that patent, the ammoniacal solution of nickel and cobalt is initially aerated to ensure that all of the cobalt has been oxidized to the trivalent state. This has generally been accomplished when oxidizing the iron and manganese and sparging with air at elevated temperatures. The oxidized solution is then contacted with a water-insoluble organic solution of a liquid ion exchange agent, such as an alphahydroxy oxime, or a 7-hydrocarbon-substituted-8-hydroxyquinoline. The nickel values are selectively extracted into the organic solution so that when the organic and aqueous solutions are separated, the aqueous raffinate comprises a solution of cobalt salt, substantially free of the nickel salts and the organic solution contains nickel values, substantially free of cobalt value. The nickel can be subsequently stripped from the organic extract phase, utilizing a weak acid solution. A more complete exposition of the extraction agents utilized for separating the nickel and cobalt is shown, e.g. in U.S. Pat. No. 3,894,139.

The solid leached ore residue from the first leaching step can then be releached in accordance with the present invention utilizing as the releaching solution an ammoniated ammonium salt solution, utilizing the same or a different ammonium salt. The ammonium salt which can be used can include any which form a soluble copper salt in an ammoniated aqueous solution. In carrying out the releaching, the reduced leached ore residue must be permitted to be at least partially reoxidized in order to oxidize the copper value to a soluble valence state. It has been found to be sufficient to merely contact the reduced ore residue with air, as by aerating the releach solution during the releaching step, so as to insure that all of the copper value has been reoxidized to its soluble state. Exposing the leached ore residue to warm air or oxygen is also sufficient to obtain the desired oxidation. Thus, the reoxidation of the reduced leached ore residue can be carried out either prior to and/or simultaneous with the leaching with the ammoniated ammonium solution. The releaching solution which, as stated above, can be the same or a different solution of ammonium salt, need not have as high a concentration of ammonia and the ammonium salt as is required for the first, or leaching, solution. It is only necessary that there be sufficient ammonium salt present to substantially fully react with all of the copper value in the ore, so as to form a soluble copper salt. As stated above, the ammonium salt is preferably present in at least a substantially stoichiometric amount to react with and dissolve all of the copper value remaining in the ore.

The resulting copper-containing ammoniated solution can then be treated to remove the copper, as by a straightforward liquid ion exchange operation, without the problem of separating any other metal values therefrom, which will result in the regeneration of the ammoniated ammonium salt solution which can then be recycled for further releaching, or leaching, of the ore. Any of the liquid ion exchange agents, described above for utilization in the separation of nickel and cobalt, can also be used for the removal of copper from the ammonium salt solution.

BRIEF DESCRIPTION OF THE DRAWINGS

Preferred examples of certain advantageous embodiments of procedures in accordance with the present invention are set forth in the accompanying drawings.

Figure 1:
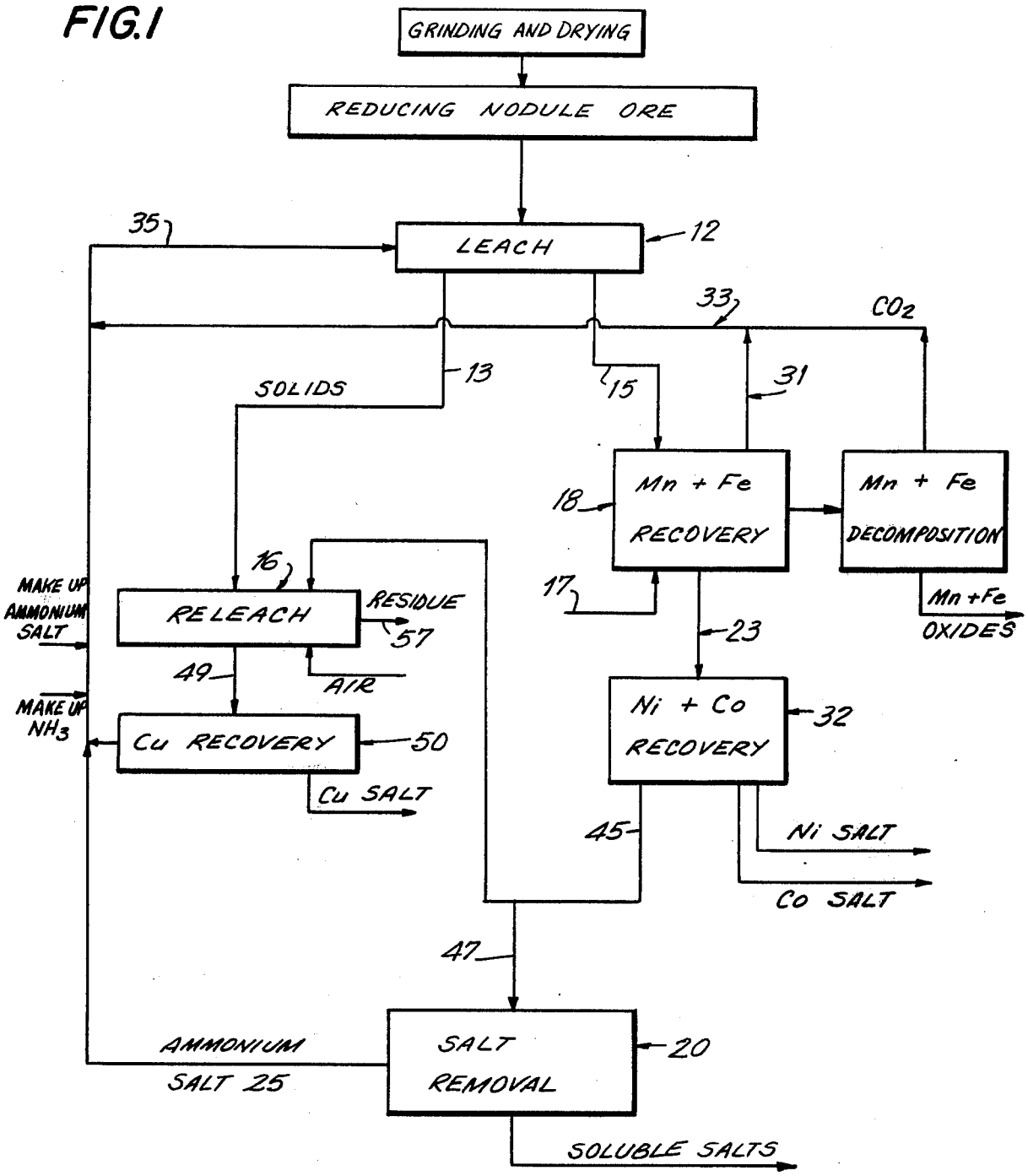
FIG. 1 is a schematic flow diagram of a system for obtaining the substantially complete separation of the metal values found in manganese nodule ores, utilizing ammonium carbonate as the leaching solution.

In the drawings, and in the following verbal description of the process, the elements of the apparatus and the general features of the procedure are shown and described in highly simplified form, and generally in an essentially symbolic manner. Appropriate structural details and parameters for actual operation are available and known to those skilled in the art and are not set forth in the description or the drawings, but are included, where necessary, in the specific examples set forth below. Generally, all process vessels and flow conduits can be of conventional construction and materials suitable for the particular reagents and products to be contained in accordance with the present process.

Referring to FIG. 1, manganese nodule ore is initially dried and then ground to a particle size preferably not greater than about 20 mesh and optimally not greater than about 50 mesh, U.S. Sieve Sizes. The dried ore particles are then admixed with a reducing agent, for example a solid carbon-containing material such as coke or coal, or a gaseous material, such as carbon monoxide, hydrogen, or a mixture thereof, at a temperature of at least about 350° C., in order to reduce the tetravalent manganese to divalent manganese and to reduce the copper value in the ore to a state, probably the zero valence, or elemental state, at which it cannot be readily leached utilizing an ammoniated ammonium salt solution. The remaining metal values in the manganese nodule ore are, however, rendered substantially leachable by the same solution. As indicated above, it is also preferred that the iron be at least partially reduced to a nonleachable state so as to substantially decrease the proportion of iron which is extracted together with the manganese.

The reduced nodules are removed from the reduction reactor, in a continuous flow operation, under an inert gas atmosphere, for example, nitrogen, and permitted to cool to below 100° C. under the inert atmosphere. The cooled reduced nodules are then quenched with a leaching solution comprising the ammoniated aqueous solution of ammonium salt. It is preferred to carry out the leaching under ambient condition, i.e. open to the atmosphere, but the leaching solution should not be directly oxygenated, e.g. as by bubbling air therethrough.

The leaching can be carried out in a single large tank reactor or in a plurality of smaller reactors, preferably wherein the aqueous solution and the solids are contacted countercurrently in a series of stages. Both of the above systems, as well as any other method for contacting the leaching liquid with the reduced nodule ore, are encompassed within the portion of the drawing generally indicated by the numeral 12.

The solid, separated from the pregnant leach liquid, is passed through conduit 13 to the releach stage 16. The pregnant leach liquid passes via conduit 15 to a manganese and iron recovery system 18, where the pregnant leach liquid is contacted with a sparge gas 17, for example, air or nitrogen, to sparge out ammonia, which is passed overhead through conduits 31 and 33 to a recycle conduit 35.

As soon as the precipitation of the iron and manganese has been completed, the sparging of the leach liquid is terminated and the liquid is passed to the nickel and cobalt recovery stage 32 via conduit 23. The precipitated iron and manganese salts, upon separation from the leach liquid, can then be decomposed at elevated temperatures especially where the manganese and iron compounds are the carbonates, which form the corresponding iron and manganese oxides and carbon dioxide. The carbon dioxide is then passed overhead through recycle stream 33, and admixed with the ammonia sparged from the manganese and iron recovery stage 18. The solid manganese and iron oxides, obtained after the decomposition of the carbonate, can then be further processed to form commercial ferromanganese by well-known reduction processes, or, if desired, can be subsequently separated.

The leach liquid, substantially free of iron and manganese, is then passed to the nickel and cobalt recovery stage 32 where it is treated, for example by liquid ion exchange extraction, so as to remove and separate the nickel and cobalt values in separate streams. The ammonium salt solution is thus regenerated and passed through the releaching line 45 to the releaching stage 16, where it is admixed with the leached reduced ore solid residue. Air is passed through the releaching liquid while it is in contact with the leached reduced ore solid residue so as to insure that the copper value is reoxidized to a leachable state.

Upon completion of the releaching, the pregnant releached liquid is separated from the solid ore residue which can then be discarded via residue line 57 and the releached liquid passed through the releach conduit 49 to the copper recovery stage 50, in which the copper salt can be recovered from the ammoniated aqueous solution, thus regenerating the ammonium salt solution. The copper salt can be obtained by either liquid ion exchange, as described above, or by precipitation from solution, for example, as copper sulfide. The regenerated ammonium salt solution passes from the copper recovery system through a recycle stream 35 and is reused to leach fresh reduced ore.

The nickel and cobalt can be separated from the leach liquid in the recovery stage 32 by the liquid ion exchange extraction procedures described above; the nickel is selectively extracted utilizing one of the aforesaid liquid ion exchange reagents, leaving an aqueous raffinate containing the dissolved cobalt value. The cobalt can then be removed by, for example, sulfide precipitation, regenerating the substantially pure ammonium salt/ammonia releaching liquid.

The thus separated nickel, copper, cobalt and manganese values can then be further treated as desired to, for example, form the elemental metals.

It has been recognized that the manganese nodule ore contains a variety of soluble metal values, especially including the alkali metals, such as sodium and potassium and magnesium. In order to prevent the build-up of such materials in the leaching liquid, a minor portion of the leaching liquid passing through the conduit 45 is separated through bleed stream 47 and passed to a salt removal stage 20; wherein the bleed stream is evaporated, and the salts obtained therefrom. The salts are continued to be heated after they are dry until the ammonium salt is decomposed and passes overhead through an ammonium salt conduit 25, at least partially as ammonia and carbon dioxide, and water vapor, which is then condensed and mixed into the aqueous solution in the recycle stream 35. As stated, additional makeup ammonium salt, as well as makeup ammonia, can be fed into the recycle stream 35, as needed.

Figure 2:
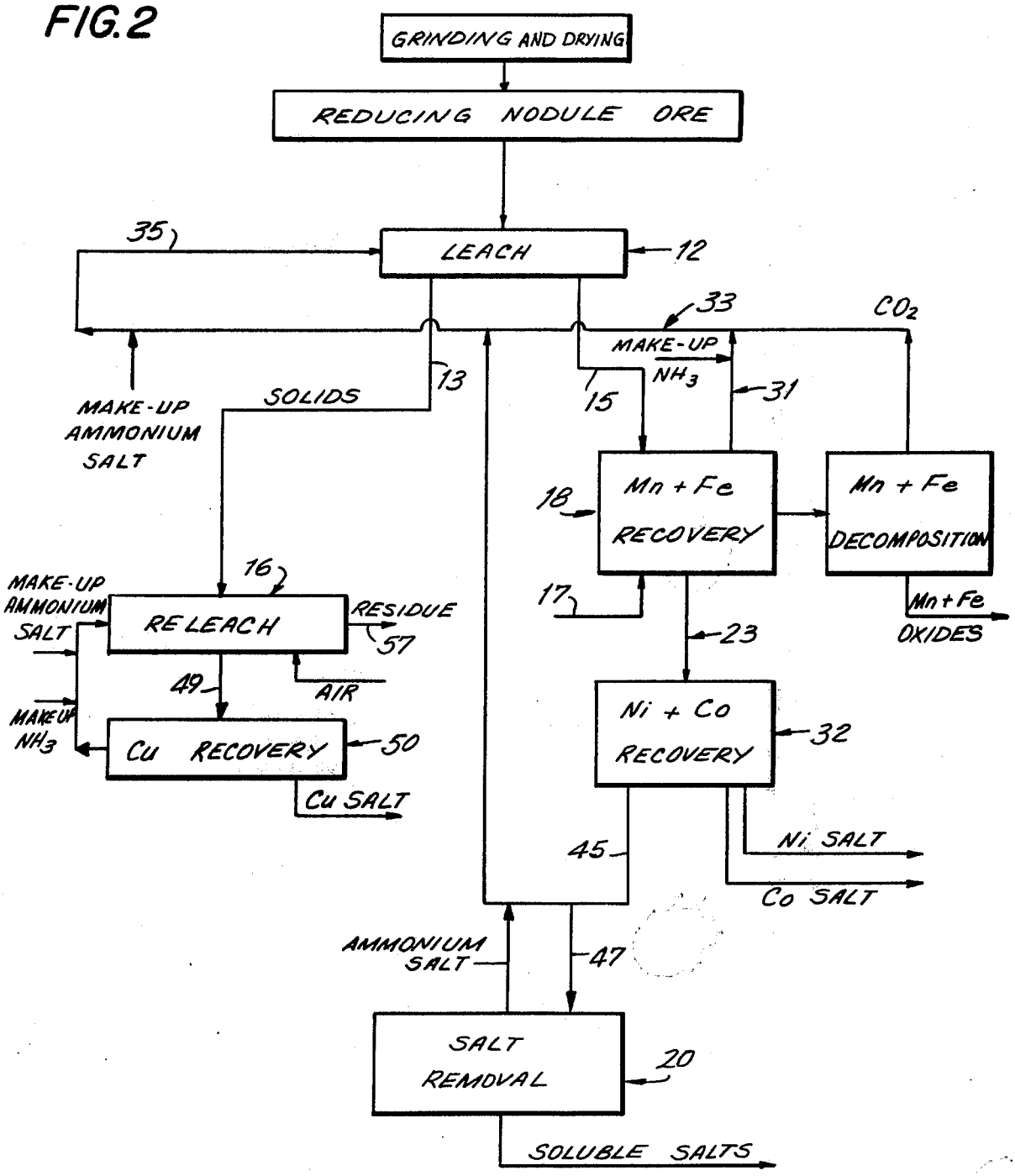
FIG. 2 is a schematic flow diagram of an alternative system.

In an alternative system, two separate solutions can be used for the leaching and releaching respectively. In this embodiment, shown in FIG. 2, the aqueous ammoniated solution leaving the nickel and cobalt recovery stage 32 is recycled back to the leaching stage 12. Similarly, the aqueous solution leaving the copper recovery stage 50 is recycled back to the releach stage 16. The bleed stream is taken off generally only from the recycle line passing back to the leaching stage 12. The releaching liquid, which picks up the ore residue following the leaching step, generally does not contain the other soluble cations as they have generally all been removed during the leaching stage. Accordingly, the bleed stream is not essential at that point. The makeup ammonium salt and makeup ammonia are thus added to each of the streams independently.

The following examples include preferred embodiment of the procedures carried out in accordance with the process of the present invention. The various process steps set forth in the following working examples, and the afore-described drawings, are intended to be merely exemplary of the present invention and do not limit the scope thereof, which encompasses procedures as broadly defined above and all equivalents thereof.

EXAMPLE 1

A sample of an ocean floor nodule ore (containing 15.2% by weight manganese, 10.2% iron, 0.54% nickel, 0.28% cobalt, and 0.09% copper), having been ground to a particle size of not greater than about 100 mesh U.S. Sieve Scale. A sample of the ore, 50 grams, is placed into a 2.5 inch Vycor tube and placed into a furnace. The tube and the contents are initially purged with nitrogen at a rate of 150cc/minute while the furnace is being heated to a temperature of about 350° C. When the operating temperature is reached, the nitrogen purge is closed off and the kiln was manually rotated 180° and back every five minutes while 300 cc/minute STP of a carbon dioxide gas (50 vol. % CO, and 50 vol. % $N_2$) was injected into the tube for a total time of 75 minutes. The carbon monoxide gas is then turned off and nitrogen is passed through the tube while the contents of the tube are permitted to cool. As soon as the tube reached a temperature of 100° C., the reduced ore was immediately passed into a 200 ml centrifuge bottle containing 175 ml ammonium carbamate solution (260 grams/liter $NH_3$, 150 grams/liter $CO_2$); the bottle was stoppered and rotated for one hour at 25° C.

Following subsequent centrifugation, the supernatant liquid was quickly decanted into a sample bottle which was than canned. The remaining solids were then admixed with 150 ml of additional fresh ammonium carbamate solution, rotated for an additional hour at 25° C., centrifuged and the supernatant liquid decanted. The two supernatant liquids were combined and the combined solution analyzed for dissolved metal values.

A second sample of the dried and ground ore is treated with the ammonium carbamate solutions in the same manner as described above, but without being initially reduced. The ammonium carbamate solutions are combined and analyzed for dissolved metal values as above.

The combined leach solution obtained from the reduced nodule ore contains the following percentages of metal values contained in the leached ore: manganese — 78.3% by weight, iron — 78.0% by weight, nickel — 92.2% by weight, and cobalt 81.0% by weight. There was less than 1% by weight of the copper leached out by the combined solutions. The supernatant leached liquid obtained from the non-reduced ore was found to contain substantially no metal values, other than the undesirable alkali and alkaline earth metals. Accordingly, it has been shown that the reduction of the ore is necessary before any substantial leaching of the metal values can be obtained utilizing an ammoniated leach solution.

The solid ore residue remaining after the first leaching set forth above is then admixed with a fresh batch of ammonium carbamate solution, this time into a mixing vessel into which air is bubbled while the liquid and solid are continuously mixed at 25° C. for one hour. Following subsequent centrifugation, the supernatant liquid was quickly decanted into a sample bottle. The remaining solids were then admixed with 150 ml. of additional fresh ammonium carbamate solution, mixed and aerated for an additional hour at 25° C., and the supernatant liquid decanted, as above. The two supernatant liquids are combined and the combined solution analyzed for dissolved metal values. The combined liquid solution obtained from the second, releaching procedure contains more than 75% by weight of the copper from the nodule ore.

EXAMPLE 2

A further sample of the dried and ground ore of Example 1 was reduced in a reformer gas atmosphere (15–20 vol. % hydrogen, 25–30 vol. % CO, 50–55 vol. % $N_2$) for a period of 75 minutes at 450° C., the reformer gas being passed over the ore at a rate of 300 cc/minute, in accordance with the procedure set forth above. The reduced ore was then cooled under a nitrogen atmosphere and a sample was leached with two batches of a leaching solution, in accordance with the procedure of Example 1. The two leaching solutions were combined and the combined solution analyzed for dissolved metal values. The following percentages by weight of the metal values in the reduced ore were found to have been dissolved into the pregnant leach solution; 73% by weight manganese, 51% by weight iron, 90% nickel, and 89.2% cobalt. Substantially no copper, less than 1% by weight, was dissolved.

A comparative test, to show the effect of overreducing the nickel and cobalt in the ore when carrying out the process of the present invention, the procedure of Example 1 was repeated by carrying out the reduction at 600° C. instead of 450° C. The percentage of metal values extracted into the pregnant leach solution were found to be as follows: manganese — 84.9%, iron — 51.9%, nickel — 19%; and cobalt — 9%. The proportion of copper leached was again less than 1%. When this ore was then aerated during the releaching stage, the remaining nickel and cobalt were extracted together with the copper, all of which had been oxidized to a leachable state.

EXAMPLE 3

An ammoniacal carbonate solution, of the type obtained by the leaching of a reduced manganese nodule ore, was prepared by forming a leaching solution by admixing 150 ml concentrated $NH_4OH$ to give a total volume of 250 ml. This dilute ammonium hydroixde solution was mixed with 250 grams of ammonium carbonate, and the resulting solution contacted with a mixture of nickel and cobalt metals to give a solution containing 6250ppm nickel and 600ppm cobalt. The solution after the leaching had a pH of 9.4. The solution was next subjected to liquid ion exchange in accordance with this process to obtain a separation of the two metal values.

The liquid ion exchange solution was an organic, water-insoluble solution comprising 5% by volume of a 7-hydrocarbon-substituted 8-hydroxyquinoline (Kelex 100), 5% isodecanol and 90% aromatic hydrocarbon solvent (Napoleum 470).

The leach solution preparaed above was contacted with an equal volume of the above-described organic liquid ion exchange solution in a mixing vessel, with continuous admixture. The mixed liquids were then permitted to settle and the upper, organic layer decanted. The loweraqueous solution, raffinate, was then contacted with a second equal volume of fresh liquid ion exchange solution according to the same procedure as above and again the organic and aqueous layers were separated. A third contact, with fresh organic liquid ion exchange solution, was made with the aqueous raffinate from the second contact. The aqueous raffinates after each of the three contacts were analyzed and the amounts of nickel and cobalt values remaining therein were determined and are set forth in the following table:

Table 1

| | Nickel (ppm) | Cobalt (ppm) |
|---|---|---|
| Feed solution | 6,250 | 600 |
| After 1st Contact | 3,500 | 600 |
| After 2nd Contact | 250 | 600 |

As shown from the above table, the nickel can be readily separated from the cobalt. Further contacts will result in the obtaining of a substantially pure nickel organic phase, leaving the cobalt substantially undisturbed in the aqueous final raffinate. The nickel can be stripped from the organic phase by a weak acid solution, for example having a pH of about 2.

The patentable embodiments of the invention which are claimed are as follows:

1. A process for selectively removing metal values from a manganese nodule ore, the ore comprising primary proportions of manganese and iron and the predominant secondary metals being nickel, copper and cobalt, the process comprising the steps of:

(a) reducing the manganese nodule ore, whereby the manganese value is rendered soluble in an ammoniated aqueous solution but whereby the copper value in the ore is reduced to a state at which it cannot be leached by ammoniated solution unless the copper value is oxidized;

(b) leaching the reduced ore with an aqueous ammoniated solution of an ammonium salt substantially without oxidizing the copper value so as to form an aqueous pregnant leach solution comprising the dissolved manganese, nickel and cobalt salts and a solid leached ore comprising the undissolved copper value, the pregnant leach solution being substantially free of dissolved copper salt, the leaching solution comprising at least about 150 gm/liter of total ammonium ($NH_4+$) ion, the concentration of ammonium hydroxide in the leaching solution being at least about 120 gm/liter, as ammonium ion, and a concentration of ammonium salt anion of at least about 0.83 Normal; and (c) oxidizing the solid leached ore residue so as to oxidize the copper value to a valence state at which it can be leached with an ammoniated aqueous solution and releaching the oxidized leached ore with an ammoniated aqueous solution of an ammonium salt to form an aqueous pregnant releach solution comprising dissolved copper salt and a solid residue.

2. The process of claim 1, wherein the amount of ammonium salt in the leaching solution is at least about substantially the stoichiometric amount required to react with all of the manganese and iron in the ore.

3. The process of claim 2, wherein the nickel and cobalt values in the ore are reduced during reduction of the ore to a state in which they are insoluble in the ammoniated leach solution and wherein the leaching solution-ore mixture is exposed to the atmosphere under mildly oxidative conditions, whereby the nickel and cobalt are oxidized to a leachable state without oxidizing the copper.

4. The process of claim 2, wherein the ammonium salt in each of the leaching solutions and the releaching solution is selected from the group consisting of ammonium sulfate, ammonium chloride, and ammonium nitrate.

5. The process of claim 1, wherein the leaching solution comprises dissolved ammonium carbonate.

6. The process of claim 1, wherein the leached ore is simultaneously aerated and releached.

7. The process of claim 1, wherein the releaching solution comprises a concentration of $NH_4OH$ of at least about 0.5 mols/liter.

8. The process of claim 1, wherein the releaching solution comprises a concentration of ammonium salt of at least about 0.25 Normal.

9. The process of claim 1, wherein the nodule ore is reduced at a temperature in the range of from 300 to about 850° C.

10. The process of claim 9, comprising in addition drying the nodule ore prior to reduction.

11. The process of claim 10, wherein the nodule ore is dried at a temperature in the range of from about 150° C. to about 250° C.

12. The process of claim 9, wherein the nodule ore is reduced by being reacted with a reducing agent selected from the group consisting of a carbonaceous reducing agent and a hydrogen-containing reducing agent.

13. The process of claim 12, wherein the carbonaceous reducing agent is selected from the group consisting of carbon, hydrocarbon compounds and carbon monoxide.

14. A process for selectively extracting the metal values from a manganese nodule ore, the ore comprising a primary proportion of manganese and iron and the predominant secondary metals being nickel, copper and cobalt, the weight ratio of manganese: iron being at least about 5:1 and the ore containing from 0.8 to 1.8 percent by wt. of copper and 1 to 2 percent by wt. of nickel, the processing comprising:

(a) comminuting the ore to a particle size of not greater than about 20 mesh;

(b) reducing the comminuted ore, at a temperature in the range of from about 300 to about 850° C., in the presence of a reducing agent selected from the group consisting of carbonaceous materials and hydrogen, such that the manganese value is reduced to a condition in which the metal value is leachable by ammoniacal ammonium salt solutions and the copper value is reduced to a state at which it cannot be leached by ammoniacal ammonium salt solution without being oxidized;

(c) leaching the reduced ore with an aqueous ammoniated solution of an ammonium salt to form a pregnant leach solution comprising dissolved manganese salt, cobalt salt, and nickel salt, but substantially free of dissolved copper salt, and a solid leached reduced ore;

(d) oxidizing the leached reduced ore so as to oxidize the copper value to a valence state at which it can be leached with an ammoniated ammonium salt solution, and releaching the oxidized solid leached ore with an ammoniated aqueous solution of an ammonium salt to form an aqueous pregnant releach solution comprising dissolved copper salt, and a solid final residue; and (e) sparging the pregnant leach solution to removed sufficient ammonia to obtain the precipitation of substantially all of the iron and manganese values therefrom to form a substantially manganeseand-iron-free pregnant leach solution and solid manganese and iron compounds; and (f) extracting the nickel and cobalt values from the leach solution so as to regenerate the ammoniated ammonium salt leaching solution.

15. The process of claim 14, wherein the regenerated ammoniated ammonium salt leaching solution is recycled and used to leach additional reduced ore.

16. The process of claim 15, wherein the sparging is carried out using air and wherein the ammonium salt is ammonium carbonate, whereby manganese carbonate and iron carbonate are precipitated and further comprising thermally decomposing the manganese and iron salts so as to form the corresponding oxides and carbon dioxide, and contacting the carbon dioxide and ammonia removed during sparging, with the regenerated ammoniated ammonium salt leaching solution to form the ammonium carbonate leaching solution and recycling the leaching solution to contact reduced nodule ore.

17. The process of claim 16, comprising in addition extracting the copper value from the pregnant releaching solution so as to regenerate the ammoniated ammonium salt releaching solution and recycling the regenerated releaching solution to contact leached reduced ore.

18. The process of claim 14, wherein the regenerated ammoniated ammonium salt leaching solution is utilized as the releaching solution to releach the leached reduced ore residue.

19. The process of claim 18, comprising in addition extracting the copper value from the pregnant releach solution so as to regenerate the ammoniated ammonium salt leaching solution and recycling the leaching solution to contact reduced nodule ore.

20. The process of claim 18, wherein the ammonium salt is ammonium carbonate and where in the sparging is carried out with air, and further comprising thermally decomposing the manganese and iron salts precipitated so as to form the corresponding oxide and carbon dioxide, and contacting the carbon dioxide and ammonia with the regenerated ammoniated ammonium salt releaching solution to form the ammonium carbonate leaching solution and recycling to contact reduced nodule ore.

21. The process of claim 14, wherein the nickel value is selectively extracted from the leach solution by contacting the leach solution with a liquid ion exchange solution selected from the group consisting of alphahydroxyoximes and 7-hydrocarbon-substituted-8-hydroxyquino lines.

22. The process of claim 14, wherein the aqueous ammoniated solution comprises at least about 260 grams/liter of total ammonium ($NH_4^+$) ion, the concentration of ammonium hydroxide in the leaching solution being at least about 120 grams/liter as ammonium ion, and the concentration of ammonium salt anion is at least about 0.83 Normal.

* * * * *

UNITED STATES PATENT AND TRADEMARK OFFICE

CERTIFICATE OF CORRECTION

PATENT NO. : 4,146,572

DATED : March 27, 1979

INVENTOR(S) : PAUL H. CARDWELL; WILLIAM S. KANE

It is certified that error appears in the above-identified patent and that said Letters Patent are hereby corrected as shown below:

Column 16, line 4, (Claim 14, line 38), correct

"manganeseand-", to read, --manganese-and---.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*